United States Patent [19]

Leonard

[11] Patent Number: 4,867,179

[45] Date of Patent: Sep. 19, 1989

[54] SYSTEM AND METHOD FOR RECLAIMING AND UTILIZING TOBACCO IN THE MANUFACTURE OF CIGARETTES

[75] Inventor: Gerard E. Leonard, Kernersville, N.C.

[73] Assignee: R. J. Reynolds Tobacco Company, Winston-Salem, N.C.

[21] Appl. No.: 108,350

[22] Filed: Oct. 14, 1987

[51] Int. Cl.[4] ..... A24B 3/18; A24C 5/00

[52] U.S. Cl. ..... 131/96; 131/108; 131/353; 131/370

[58] Field of Search ..... 131/108, 96, 370, 353, 131/280

[56] References Cited

U.S. PATENT DOCUMENTS

| | | |
|---|---|---|
| 3,026,880 | 3/1962 | Perrin . |
| 3,103,222 | 9/1963 | DiIanni . |
| 3,219,042 | 11/1965 | Molins . |
| 3,224,451 | 12/1965 | Dearsley . |
| 3,386,320 | 6/1968 | Pinkham et al. . |
| 3,577,999 | 5/1971 | Pinkham . |
| 3,757,799 | 9/1973 | DiIanni . |
| 4,074,722 | 2/1978 | Kohnhorst . |
| 4,083,499 | 4/1978 | Thatcher . |
| 4,117,852 | 6/1978 | Newman et al. . |
| 4,191,199 | 3/1980 | Sullivan . |
| 4,278,100 | 7/1981 | Thatcher . |
| 4,337,783 | 7/1982 | Hooper et al. . |
| 4,485,827 | 12/1984 | Komossa et al. . |
| 4,622,875 | 11/1986 | Emery et al. . |
| 4,646,759 | 3/1987 | Thatcher et al. . |
| 4,646,764 | 3/1987 | Young et al. . |

*Primary Examiner*—V. Millin

*Attorney, Agent, or Firm*—Grover M. Myers

[57] ABSTRACT

A system and method for reclaiming tobacco from rejected products and byproducts of a cigarette manufacturing operation are disclosed. The tobacco that is reclaimed from rejected cigarettes, long ends and defective packs of cigarettes is screened to separate a fraction of larger tobacco particles that can be returned directly to the cigarette manufacturing machines. The fraction of smaller tobacco particles and fines produced by the screening treatment is combined with stem material and tobacco dust recovered from the manufacturing operation to produce strands of reconstituted tobacco which are incorporated into the cut tobacco that is supplied to the cigarette manufacturing machines.

17 Claims, 1 Drawing Sheet

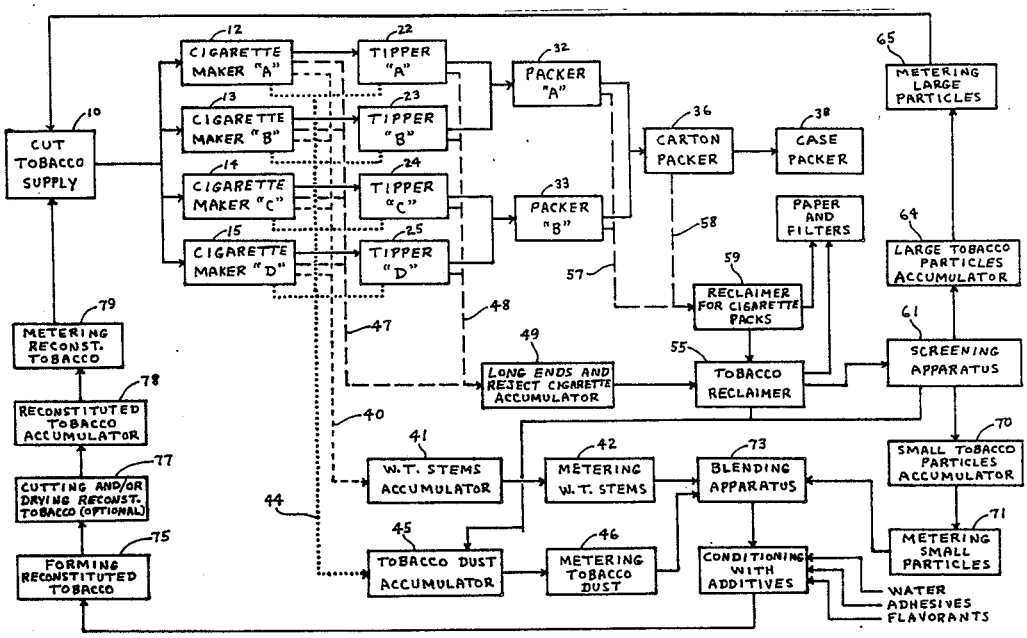

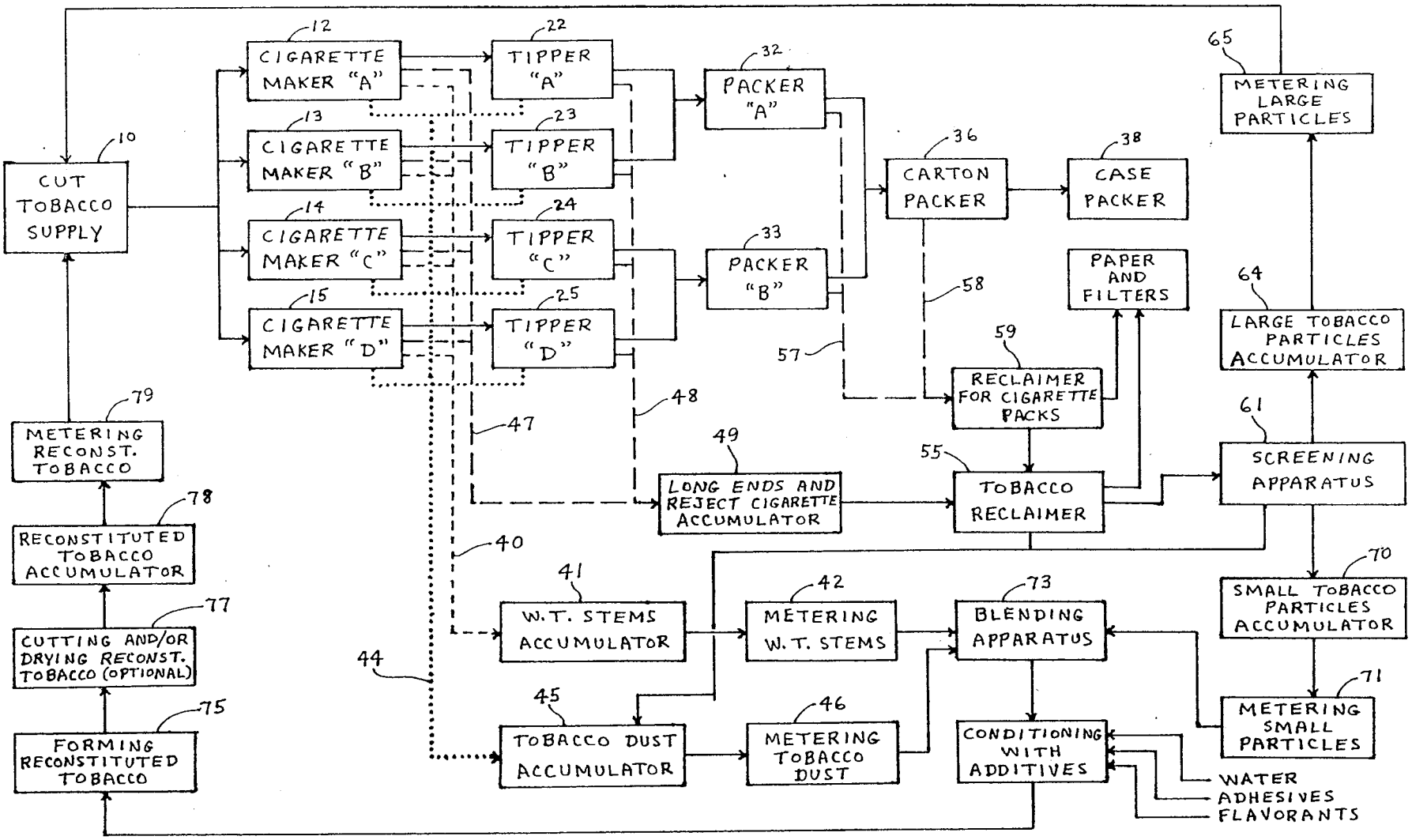
METERING LARGE PARTICLES
65
LARGE TOBACCO PARTICLES ACCUMULATOR
64
SCREENING APPARATUS
61
SMALL TOBACCO PARTICLES ACCUMULATOR
70
METERING SMALL PARTICLES
71
WATER
ADHESIVES
FLAVORANTS
CASE PACKER
38
PAPER AND FILTERS
RECLAIMER FOR CIGARETTE PACKS
59
TOBACCO RECLAIMER
55
BLENDING APPARATUS
73
CONDITIONING WITH ADDITIVES
CARTON PACKER
36
58
PACKER "A"
32
PACKER "B"
33
57
LONG ENDS AND REJECT CIGARETTE ACCUMULATOR
49
METERING W.T. STEMS
42
METERING TOBACCO DUST
46
TIPPER "A"
22
TIPPER "B"
23
TIPPER "C"
24
TIPPER "D"
25
48
47
40
W.T. STEMS ACCUMULATOR
41
TOBACCO DUST ACCUMULATOR
45
44
CIGARETTE MAKER "A"
12
CIGARETTE MAKER "B"
13
CIGARETTE MAKER "C"
14
CIGARETTE MAKER "D"
15
CUT TOBACCO SUPPLY
10
METERING RECONST. TOBACCO
79
RECONSTITUTED TOBACCO ACCUMULATOR
78
CUTTING AND/OR DRYING RECONST. TOBACCO (OPTIONAL)
77
FORMING RECONSTITUTED TOBACCO
75

SYSTEM AND METHOD FOR RECLAIMING AND UTILIZING TOBACCO IN THE MANUFACTURE OF CIGARETTES

TECHNICAL FIELD

The present invention relates to a system and method for reclaiming tobacco from a cigarette manufacturing operation and for processing the reclaimed tobacco so that it may be used again in that cigarette manufacturing operation.

BACKGROUND OF THE INVENTION

The manufacture and commercial distribution of cigarettes, both filter and nonfilter types, give rise to significant quantities of products which for various reasons do not reach the consumer. Since the tobacco contained in these products is a costly commodity and is, in most instances, in satisfactory condition for reuse in the manufacture of cigarettes, apparatus has been developed for recovering tobacco from cigarettes so that it may be subsequently used again in the manufacture of smoking products.

Apparatus disclosed in the prior art for recovering cut tobacco filler from cigarettes takes a variety of forms due to the varying forms of the products which are designated for the reclaiming operation. For example, each time a cigarette making machine is started up a substantial length of uncut tobacco rod (usually referred to as "long ends") is formed before all phases of the making process become fully operational. Manufactured cigarettes may also be rejected by the inspection devices on the making machine when defects such as imperfect seam seals on the cigarette paper or tipping paper are detected.

Defects in packaging may also lead to the recovery of cigarettes from packs and/or cartons of cigarettes. Thus, the prior art discloses apparatus for sorting and opening packs of cigarettes as well as for separating tobacco from paper and the filter tips of filter cigarettes.

One negative feature that is inherent in most methods for reclaiming tobacco from cigarettes is that the particle sizes of the cut tobacco are reduced due to mechanical abrasion associated with the reclaiming process. Therefore, all of the reclaimed tobacco is generally used in the manufacture of reconstituted tobacco sheets which are cut or shredded before being returned to the cigarette manufacturing operation. The preparation and use of reconstituted tobacco have been practiced in the tobacco industry for many years but it has been necessary to carry out a reconstituted tobacco manufacturing operation on a relatively large scale to make it economically attractive. This, in turn, has necessitated a tobacco reclaiming operation that is also relatively large scale in nature. Hence, it has been customary in the industry to collect reject cigarettes, "long ends" and defective packages of cigarettes for reclaiming in one centralized location. That practice has resulted in another negative feature that is inherent in present reclaiming methods, namely, the partial loss of brand integrity. Each brand of cigarettes produced by a manufacturer has a particular blend of tobaccos and flavoring materials applied to the tobacco. The processing of different brands of cigarettes in a tobacco reclaiming operation necessarily results, therefore, in a combination of tobacco materials that reflect different flavor formulations and tobacco blend formulations. To the extent that such reclaimed materials are returned and used in the manufacture of a given brand of cigarette, even if in the form of reconstituted tobacco, that use comprises the integrity of that brand's unique smoking characteristics.

SUMMARY OF THE INVENTION

The present invention involves a system and method for reclaiming and recycling tobacco materials in a cigarette manufacturing operation which preserves the smoking characteristics and integrity of each cigarette brand produced in that operation. A principal advantage of the invention is that a substantial proportion of the reclaimed tobacco is recycled without first forming it into a reconstituted tobacco. This invention also minimizes the time required for recycling the reclaimed tobacco thereby preventing the loss of smoking quality of the reclaimed tobacco caused by excessive and prolonged handling of the tobacco during the recycling phase of the operation. The disclosed system and method also provide improved economy of operation as a result of the shorter recycling time, a reduction in the quantity of tobacco material that is used in a costly reconstituting process and the combination of processing steps used. Cigarette brand integrity is maintained by segregating the tobacco reclaimed from a given brand and reusing the segregated tobacco only in the manufacture of that brand.

The system for reclaiming and recycling tobacco materials in accordance with this invention comprises means for collecting tobacco rods and cigarettes from a designated group of cigarette making machines, separate means for collecting tobacco stems and tobacco dust recovered from the designated group of cigarette making machines, means for recovering cut tobacco from the collected tobacco rods and cigarettes, means for processing the recovered cut tobacco to obtain a first fraction of reclaimed cut tobacco consisting predominantly of tobacco particles which are larger than a minimum predetermined size and a second fraction of reclaimed cut tobacco consisting predominantly of tobacco particles smaller than the minimum size of the predominant particles in the first fraction, first metering means for introducing controlled quantities of the first fraction of reclaimed cut tobacco into cut tobacco being supplied to the designated group of cigarette making machines, means for blending controlled proportions of the collected tobacco stems and tobacco dust with the second fraction of reclaimed cut tobacco to produce a blended mixture of tobacco material, means for forming the blended mixture of tobacco material into strands of reconstituted tobacco and second metering means for introducing controlled quantities of the reconstituted tobacco strands into the cut tobacco being supplied to the designated group of cigarettes making machines. The system optionally includes means for recovering cigarettes and tobacco from packs or cartons of cigarettes which have been packaged by packing machines associated with the designated group of cigarette making machines.

The presently disclosed method for reclaiming and recycling tobacco materials in a cigarette manufacturing operation comprises the steps of collecting tobacco rods and cigarettes from a designated group of cigarette making machines, separately collecting tobacco stems and tobacco dust recovered from the designated group of cigarette making machines, recovering cut tobacco from the collected tobacco rods and cigarettes, separating the recovered cut tobacco into a first fraction of reclaimed cut tobacco consisting predominantly of tobacco particles which are larger than a minimum predetermined size and a second fraction of reclaimed cut tobacco consisting predominantly of tobacco particles smaller than the minimum size of the predominant particles in the first fraction introducing controlled quantities of the first fraction of reclaimed cut tobacco into cut tobacco that is being supplied to the designated group of cigarette making machines, blending controlled proportions of said second fraction of reclaimed cut tobacco with controlled proportions of the collected tobacco stems and tobacco dust to produce a blended mixture of tobacco material, forming the blended mixture of tobacco material into strands of reconstituted tobaccco and introducing controlled quantities of the reconstituted tobacco strands into the cut tobacco that is being supplied to the designated group of cigarette making machines. The disclosed method optionally includes the step of collecting cigarettes and cut tobacco from packs or cartons of cigarettes which have been packaged by packaging machines associated with the designated group of cigarette making machines.

DRAWING

The single FIGURE shows a schematic block diagram of a cigarette manufacturing operation which incorporates the tobacco reclaiming and recycling features of the present invention.

DETAILED DESCRIPTION OF THE INVENTION

This invention is designed for use in a cigarette manufacturing operation wherein a number of different cigarette brands are being manufactured in the same general production area. By different cigarettes brands is meant not only different name brands of cigarettes but also different styles within a given brand family which may have sufficiently different tobacco blend and flavoring characteristics to warrant separate tobacco treatment and storage facilities for each brand style. Thus, a particular brand that is produced in both menthol and nonmenthol versions would be regarded as being sufficiently different to justify separate processing of tobacco used in those versions. In a typical operation, the manufacture of a given brand of cigarettes is carried out using one or more cigarette making machines which are capable of producing the number of cigarettes required to meet consumer demand. The output from the cigarette making machine(s) is fed to the required number of machines for packaging the cigarettes into packs, cartons and cases of cigarettes. Devices and techniques currently used for removing "long ends" as well as substandard cigarettes and packages from the production line would continue to be used with the present invention. However, the removed product from a group of making and packaging machines designated for the production of a particular cigarette brand would be segregated and processed separately from product removed from a second group of making and packaging machines devoted to the production of another cigarette brand. Separate treatment would also be accorded to tobacco dust and tobacco stem material (e.g., winnower throw-out stems) usually recovered from cigarettes making machines. The collected materials from production of a given brand of cigarettes are conveyed or moved to tobacco reclaiming devices or temporary storage bins using conventional equipment and techniques known in the art.

The "long ends" and substandard cigarettes collected from the designated group of making and packaging machines are directed to devices known in the art for reclaiming tobacco therefrom. For example, U.S. Pat. Nos. 3,577,999, 3,757,799, 4,278,100 and 4,485,827 describe apparatus for recovering the cut tobacco filler from cigarettes. The prior art also discloses apparatus for opening cigarette packages for the purpose of reclaiming tobacco therein as exemplified by U.S. Pat. Nos. 3,386,320, 4,083,499 and 4,622,875. Equipment for opening packages of cigarettes is also commercially available (e.g., a packet opening machine available from Tingey & Company Ltd. of Surrey, England). The teachings of the patents identified above are incorporated herein by reference so that further details need not be enumerated here. The particular devices employed for reclaiming the tobacco is not critical but it is preferred that devices and techniques be selected which would not lead to excessive generation of smaller particle sizes or result in a significant change in the moisture content of the reclaimed tobacco. It is also preferred that the reclaiming equipment be located in the environment of the controlled temperature and humidity zone generally associated with cigarette manufacturing and packaging operations so that the reclaimed tobacco that is returned directly to the cut tobacco filler supplied to the cigarette making machines will have the proper moisture levels. Locating the tobacco reclaiming equipment in the immediate vicinity of the cigarette making and packing operation will also eliminate the cost of transporting the materials to and from a separate, remotely located reclaiming facility.

The method and apparatus used for recovering tobacco from the "long ends" and substandards products necessarily result in some reduction in particle size of the tobacco as well as generation of fines. Therefore, returning all of the recovered tobacco to the cigarette making machines without further processing may have an adverse effect on the pressure drop across the tobacco rod of the cigarettes produced. Consequently, it is important that the recovered tobacco be processed to remove the fines and smaller particles therefrom before returning the larger particles to the cut tobacco feed that is supplied to the cigarette making machines. This can be accomplished by subjecting the reclaimed tobacco to a screening or sieving operation using equipment known in the art. The tobacco particles which are returned directly to the cigarette manufacturing operation are those which are retained on a 24 mesh screen (Tyler Standard Screen Scale Sieves Series) and preferably those which are retained on a Tyler 20 mesh screen and most preferably those which are retained on a Tyler 16 mesh screen. It should be understood that the screening or sieving operation may not produce a complete separation of the fines and smaller particles from the larger particles but the predominant portion of the tobacco returned directly to the cigarette making machine will be particles that will not pass through the screen selected. Thus, reference herein to a tobacco fraction consisting predominantly of tobacco particles larger than a predetermined minimum is intended to mean a fraction in which at least 75 percent by weight of the fraction is made up of particles greater in size than the predetermined minimum.

The portion of the reclaimed tobacco which passes through the screen or sieve selected consists of smaller tobacco particles and fines. A key part of the presently disclosed reclaiming and recycling system is the manner in which the small particles and fines are processed for recycling. The tobacco stems and tobacco dust recovered from the cigarette making machines are combined with the small tobacco particles and fines derived from the reclaimed tobacco that is screened or sieved and the blended mixture is formed into strands of reconstituted tobacco. The reconstitution process employed should avoid the addition of substantial quantities of water but, rather, should include only enough water to promote the formation of a stable strand of reconstituted tobacco. Using only minimal amounts of water will reduce requirements for drying of the reconstituted tobacco formed. It is generally unnecessary to increase water levels to more than 60 percent by weight based on the total weight of the moistened blend of tobacco materials. Preferably, the proportion of water in the moistened blend of tobacco materials should be between 14 and 30 percent by weight. If necessary, the blended tobacco materials may be ground or comminuted before preparing the moistened blend for reconstitution and the blend may also contain adhesive binders, flavorants and other additives. The actual forming process may be effected by extrusion, deposition on a casting surface or other techniques known in the art. The formed reconstituted tobacco is then dried to a moisture level of about 11 to 20 percent and is cut or shredded, if necessary, to produce strands of reconstituted tobacco that are added at desired use levels to the cut tobacco that is supplied to the cigarette making machines.

The formulations for the reconstituted tobacco strands formed will vary somewhat depending on the nature of the tobacco material collected for recycling. The formulations will, of course, include the stem material that is separated by the winnower throw-out device on the cigarette making machine. Operating experience over a period of time with a designated group of cigarette making and packaging machines will provide data on the approximate proportions of stem material, small leaf particles and tobacco dust or fines that will be recovered on a routine basis. An appropriate formulation can then be developed which will provide sufficient latitude to accommodate variations in the proportions of the different reconstituted tobacco components anticipated.

A typical procedure for preparing a reconstituted tobacco sheet is disclosed in U.S. Pat. No. 4,337,783 wherein a slurry of ground tobacco particles, binder and 30 to 60 percent water is extruded and dried. A particularly preferred method for forming strands of reconstituted tobacco useful in connection with this invention is a pressurized roller technique disclosed in U.S. Pat. No. 4,646,764, the teachings of which are incorporated herein by reference. In that patent a blend containing between 15 and 60 percent by weight stem material and 14 to 30 percent by weight water is formed directly into strands by a pressurized roller system. The relatively small quantities of water used in forming the strands mean that only modest drying requirements, if any, are necessary with that technique. The space requirements for the pressurized roller system are quite modest and make it ideally suited for use in the tobacco reclaiming and recycling system presently disclosed.

Since any tobacco reclaiming operation will typically have a fluctuating input and output, it is desirable to incorporate temporary storage or accumulator means in the presently disclosed system so that the reclaimed tobacco can be processed and reincorporated into the cigarette manufacturing operation in an orderly, controlled manner. This will ensure that the entire reclaiming and recycling system will operate in a substantially continuous manner and that none of the cigarettes produced will contain excessive levels of reclaimed tobacco materials. Suitable metering or feed means are used in conjunction with the various storage or accumulator means to control and monitor the flow of tobacco materials to the appropriate processing equipment or supply streams. Apparatus for feeding metered quantities of particulate tobacco material is well known and widely used in the tobacco industry and does not constitute a part of this invention as such.

For a better understanding of the present invention reference will now be made to the accompanying drawing which shows a schematic block diagram of a tobacco reclaiming and recycling system in accordance with this invention. Although the diagram depicts a system with four filter cigarette making machines, two packers, one carton packer and a case packer, it should be understood that any number of machines manufacturing a particular brand of cigarettes may be grouped together with consideration, of course, being given to the production capacities of the grouped making and packaging machines. It is possible that a single cigarette making machine, one packer, one carton packer and one case packer could be used for producing a given brand of cigarettes. Thus, the reference to a designated group of cigarette making machines in this disclosure and the appended claims is intended to include a system having only one cigarette making machine.

Cigarette making machines 12, 13, 14 and 15 receive cut tobacco filler from cut tobacco supply 10 for the purpose of forming tobacco rods which are transported, respectively, to tippers 22, 23, 24 and 25 which attach filters to the tobacco rods with tipping paper. The filter cigarettes produced are then conveyed to packers 32 and 33 for assembling into packs of cigarettes containing the desired number of cigarettes in each. The packs of cigarettes produced are further packaged in cartons by carbon packer 36 and in cases by case packer 38 for shipment to distributors.

Incident to the manufacturing steps described above, a quantity of tobacco-containing material is recovered from the various machines. Thus, tobacco stem material is recovered from a winnower device on each of cigarette makers 12, 13, 14 and 15 and the recovered "W.T." stems are conveyed via line 40 to W.T. stem accumulator 41. Tobacco dust which is recovered from makers 12, 13, 14 and 15 and tippers 22, 23, 24 and 25 is transported to tobacco dust accumulator 45 as depicted by line 44. The "long ends" and imperfect cigarettes produced by makers 12, 13, 14 and 15 and tippers 22, 23, 24 and 25 are transported to accumulator 49, as depicted by lines 47 and 48, and then to tobacco reclaimer 55 where the tobacco is separated from the paper and filter materials. Filter cigarettes which are packaged in packs and cartons found to be defective are also subjected to a reclaiming procedure. Rejected packs from packers 32 and 33 and rejected cartons from carton packer 36 are routed to packaged cigarette reclaimer 59 as depicted by lines 57 and 58, respectively. Reclaimer 59 may be designed specifically for opening packs of cigarettes in which case separate means (not shown) are employed for removing packs from rejected cartons of cigarettes routed to reclaimer 59 via line 58. Filter cigarettes recovered by reclaimer 59 are sent to tobacco reclaimer 55 for separating tobacco from the paper and filters.

The cut tobacco that is reclaimed by tobacco reclaimer 55 is screened by screening apparatus 61 which retains the larger particles of predetermined minimum size for subsequent transport to accumulator 64 and cut tobacco supply 10 via metering device 65. Tobacco dust generated by tobacco reclaimer 55 and screening apparatus 61 is sent to tobacco dust accumulator 45 as indicated by line 67. The small tobacco particles which pass through the screen in screening apparatus 61 are stored temporarily in accumulator 70 for subsequent use in preparing strands of reconstituted tobacco from the small tobacco particles, the W.T. stems and the tobacco dust. The formation of reconstituted tobacco from the recovered tobacco materials is accomplished by introducing into blending apparatus 73 desired proportions of W.T. stems, tobacco dust and small tobacco particles via respective metering devices 42, 46 and 71. Depending on the particular method used for preparing the reconstituted tobacco, predetermined amounts of water, adhesives and flavorants as desired may optionally be introduced into the blend of tobacco materials in apparatus 73. The blended and conditioned tobacco materials are extruded or otherwise formed into strands or sheets of reconstituted tobacco by forming apparatus 75. If the reconstituted tobacco is produced in sheet form, the sheet is subjected to a cutting and drying treatment by cutter and dryer 77 to produce tobacco strands which are stored in accumulator 78. If the forming method employed is capable of producing strands of reconstituted tobacco directly having acceptable moisture levels (e.g., the method disclosed in U.S. Pat. No. 4,646,764), the drying and cutting step depicted by 77 is either unnecessary or may be limited to drying only. The strands of reconstituted tobacco produced from the reclaimed tobacco are metered at desired rates into cut tobacco supply 10 via metering device 79.

What is claimed is:

1. A apparatus for reclaiming and recycling tobacco materials in a cigarette manufacturing operation comprising in combination:

(a) means for collecting tobacco rods and cigarettes from a designated group of cigarette making machines, (b) separate means for collecting tobacco stems and tobacco dust recovered from cigarette making machines in said designated group of machines, (c) means for recovering cut tobacco from said tobacco rods and cigarettes, (d) means for processing the recovered cut tobacco to produce a first fraction of reclaimed cut tobacco consisting predominantly of tobacco particles that will not pass through a Tyler 24 mesh screen and a second fraction of reclaimed cut tobacco consisting predominantly of tobacco particles smaller than the minimum size of the predominant particles in said first fraction, (e) first metering means for introducing controlled quantities of said first fraction of reclaimed cut tobacco into cut tobacco being supplied to the cigarette making machines in said designated group of machines, (f) means for blending controlled proportions of said tobacco stems, tobacco dust and said second fraction of reclaimed cut tobacco to produce a blended mixture of tobacco material, (g) means for forming the blended mixture of tobacco material into strands of reconstituted tobacco and (h) second metering means for introducing controlled quantities of said strands of reconstituted tobacco into the cut tobacco being supplied to said designated group of cigarette making machines.

2. The apparatus of claim 1 wherein said means for collecting tobacco rods and cigarettes includes means for recovering cigarettes from packages or cartons of cigarettes produced by packaging machines associated with said designated group of cigarette making machines.

3. The apparatus of claim 1 wherein the means for processing the recovered cut tobacco is designed to produce a first fraction of reclaimed cut tobacco consisting predominantly of tobacco particles that will not pass through a Tyler 20 mesh screen and a second fraction of reclaimed cut tobacco consisting predominantly of tobacco particles smaller than the minimum size of the predominant particles in said first fraction.

4. The apparatus of claim 1 wherein the means for processing the recovered cut tobacco is designed to produce a first fraction of reclaimed cut tobacco consisting predominantly of tobacco particles that will not pass through a Tyler 16 mesh screen and a second fraction of reclaimed cut tobacco consisting predominantly of tobacco particles smaller than the minimum size of the predominant particles in said first fraction.

5. The apparatus of claim 1 wherein said means for forming the blended mixture of tobacco material into strands of reconstituted tobacco comprises a pressurized roller device designed to form reconstituted tobacco from a blended mixture of tobacco material having a moisture content between 14 and 30 percent by weight.

6. The apparatus of claim 1 wherein said means for forming the blended mixture of tobacco material into strands of reconstituted tobacco comprises an extrusion device designed to form reconstituted tobacco from a blended mixture of tobacco material having a moisture content between 30 and 60 percent by weight.

7. The apparatus of claim 5 or 6 which additionally includes means for drying the reconstituted tobacco formed from the blended mixture of tobacco material to a moisture level of 11 to 20 percent by weight.

8. The apparatus of claim 7 which additionally includes means for cutting, shredding or otherwise comminuting the formed reconstituted tobacco to produce particle sizes suitable for use in the manufacture of cigarettes.

9. A method for reclaiming and recycling tobacco materials in a cigarette manufacturing operation comprising the steps of (a) collecting rejected tobacco rods and cigarettes from a designated group of cigarette making machines, (b) separately collecting tobacco stem material and tobacco dust recovered from said designated group of cigarette making machines, (c) recovering cut tobacco from said rejected tobacco rods and cigarettes and separating the recovered cut tobacco into a first fraction of reclaimed cut tobacco consisting predominantly of tobacco particles that will not pass through a Tyler 24 mesh screen and a second fraction consisting predominantly of tobacco particles smaller than the minimum size of the predominant particles in said first fraction, (d) introducing controlled quantities of said first fraction of reclaimed cut tobacco into cut tobacco that is being supplied to said designated group of cigarette making machines, (e) blending controlled proportions of said second fraction of reclaimed cut tobacco with controlled proportions of the collected tobacco stems and tobacco dust to produce a blended mixture of tobacco material, (f) forming the blended mixture of tobacco material into strands of reconstituted tobacco and (g) introducing controlled quantities of said strands of reconstituted tobacco into the cut tobacco that is being supplied to said designated group of cigarette making machines.

10. The method of claim 9 wherein the recovered cut tobacco is separated into a first fraction of reclaimed cut tobacco consisting predominantly of tobacco particles that will not pass through a Tyler 20 mesh screen and a second fraction consisting predominantly of tobacco particles smaller than the minimum size of the predominant particles in said first fraction.

11. The method of claim 9 wherein the recovered cut tobacco is separated into a first fraction of reclaimed cut tobacco consisting predominantly of tobacco particles that will not pass through a Tyler 16 mesh screen and a second fraction consisting predominantly of tobacco particles smaller than the minimum size of the predominant particles in said first fraction.

12. The method of claim 9 which includes the additional step of collecting cigarettes and cut tobacco from packages and cartons of cigarettes produced by packaging machines associated with said designated group of cigarette making machines and combining the collected cigarettes and cut tobacco with the rejected tobacco rods and cigarettes obtained from said designated group of cigarette making machines for further processing.

13. The method of claim 9, 10, 11 or 12 wherein the blended mixture of tobacco material has a moisture content of 14 to 30 percent by weight at the time it is formed into a reconstituted tobacco product by a pressurized roller device.

14. The method of claim 9, 10, 11 or 12 wherein the blended mixture of tobacco material has a moisture content of 30 to 60 percent by weight at the time it is formed into a reconstituted tobacco product by an extrusion device.

15. The method of claim 13 wherein the reconstituted tobacco formed from the blended mixture of tobacco material is dried to a moisture level of 11 to 20 percent by weight before it is introduced into the cut tobacco that is being supplied to said designated group of cigarette making machines.

16. The method of claim 14 wherein the reconstituted tobacco formed from the blended mixture of tobacco material is dried to a mixture level of 11 percent to 20 percent by weight before it is introduced into the cut tobacco that is being supplied to said designated group of cigarette making machines.

17. The method of claim 9 wherein the step of forming the blended mixture of tobacco material into strands of reconstituted tobacco includes cutting or shredding of a formed sheet of reconstituted tobacco.

* * * * *